United States Patent [19]

Strausburg

[11] 4,263,086

[45] Apr. 21, 1981

[54] HAND-HELD LABELER

[75] Inventor: Larry D. Strausburg, Kettering, Ohio

[73] Assignee: Monarch Marking Systems, Inc., Dayton, Ohio

[21] Appl. No.: 159,023

[22] Filed: Jun. 13, 1980

[51] Int. Cl.[3] ..... B44C 1/00

[52] U.S. Cl. ..... 156/542; 242/71.8

[58] Field of Search ..... 242/68, 68.4, 71.8, 242/71.9, 76; 156/541, 542

[56] References Cited

U.S. PATENT DOCUMENTS

| | | | |
|---|---|---|---|
| 3,220,663 | 11/1965 | Plato | 242/71.8 |
| 3,342,435 | 9/1967 | Gelardi | 242/71.8 |
| 3,440,123 | 4/1969 | Hamisch | 156/384 |
| 4,024,005 | 5/1977 | Jenkins | 156/384 |
| 4,116,747 | 9/1978 | Hamisch | 156/384 |

*Primary Examiner*—David A. Simmons

*Attorney, Agent, or Firm*—Joseph J. Grass

[57] ABSTRACT

There is disclosed a hand-held labeler which has a housing that carries a supply roll of labels. The labels can be successively dispensed in response to actuation of a manually operable actuator. The supply roll is prevented from unraveling by means of an improved retainer having a pair of arms which prevent the supply roll from telescoping. The arms have flanges which prevent the roll from excessive unwinding or mushrooming.

8 Claims, 5 Drawing Figures

HAND-HELD LABELER

BACKGROUND OF THE INVENTION

1. Field of the Invention

This invention relates to the art of hand-held labelers.

2. Brief Description of the Prior Art

U.S. Pat. Nos. 3,440,123 to Paul H. Hamisch, Sr. granted Apr. 22, 1969, 4,148,678 to Fogle et al granted Apr. 10, 1979 and 4,116,747 to Paul H. Hamisch, Jr. granted May 8, 1979 disclose hand-held labelers with structure for preventing telescoping and/or mushrooming of the label roll. Instead of providing full circumference discs to prevent telescoping as in U.S. Pat. No. 4,116,747, it has been tried to use freely rotatable discs with three arms radiating outwardly from a central portion.

SUMMARY OF THE INVENTION

This invention relates to the type of hand-held labeler in which at least a portion of a label roll extends outside a housing. The label roll is rotatably mounted in the housing. In accordance with a specific embodiment, a pair of retainers restrains the label roll from lateral or telescoping movement. Each retainer has a pair of arms that extend outwardly from a central portion. The label roll is mounted between the retainers on spaced mounting members. Each retainer has a plurality of arms. The arms are prevented from rotating so that the arms will always be in the optimum position. Stops molded integrally with each retainer contact the housing at spaced locations to prevent rotational movement. The arms are relatively thin and narrow so that a new label roll can be readily inserted onto the mounting members. The arms provide relatively free access to the mounting members. The arms are preferably molded integrally with a central portion. The retainer is illustrated to have two arms although more than two arms can be provided. It is preferred that one of the arms be made to extend upwardly and slightly to the rear of the labeler and the other arm be made to extend downwardly and slightly to the rear of the labeler. The outer end portions of the arms have flanges in alignment with the label roll that prevent the label roll from mushrooming or unwinding excessively. The flanges of one retainer extend toward the flanges of the other retainer. The flanges have converging end edges opening generally toward the rear of the apparatus to facilitate loading of a label roll onto the mounting members. Each retainer has a hole for receiving a shaft formed integrally with a respective label roll mounting member. Thus, the shaft rotatably mounts the respective mounting member and also mounts the respective retainer.

BRIEF DESCRIPTION OF THE DRAWINGS

FIG. 2 is a rear elevational view, partly in section, of the labeler;

FIG. 3 is a fragmentary side elevational view showing in particular the left-hand retainer;

FIG. 4 is an enlarged sectional view showing the construction of one roll mounting member and its interrelation to the respective retainer and the housing and a subframe; and FIG. 5 is a fragmentary top plan view showing in particular the retainers.

DETAILED DESCRIPTION OF A PREFERRED EMBODIMENT

Figure 1:
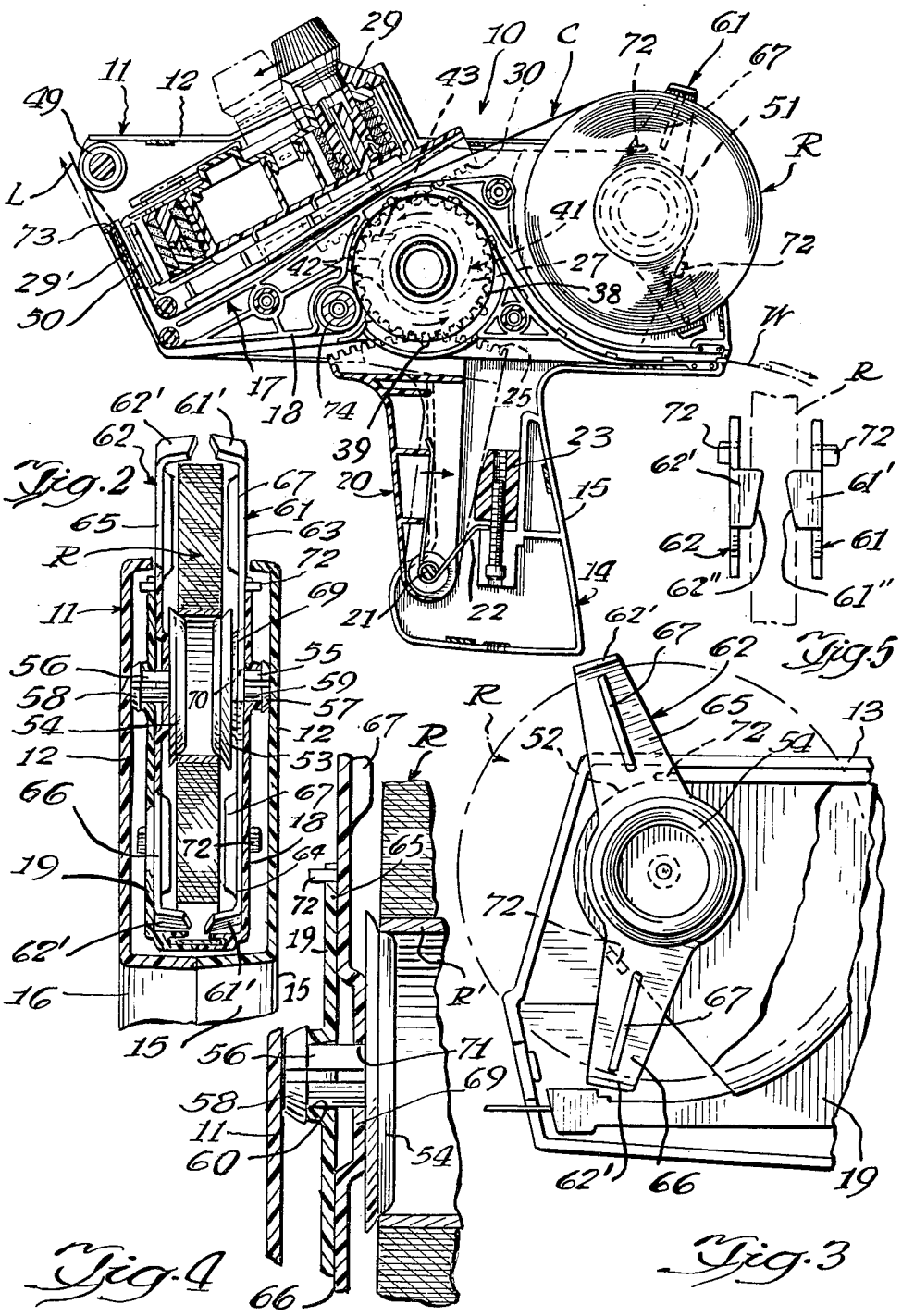
FIG. 1 is a side elevational sectional view of a labeler in accordance with the invention showing in particular the right-hand retainer.

With reference to FIG. 1, there is shown a labeler generally indicated at 10 including a housing or frame generally indicated at 11 including generally mirror-image housing sections 12 and 13. The housing sections 12 and 13 provide a downwardly extending handle 14 composed of handle portions 15 and 16. The housing 11 mounts a subframe generally indicated at 17 which includes subframe sections 18 and 19. The subframe sections 18 and 19 extend in generally side-by-side relation and are substantially mirror images. An actuator 20 pivotally mounted on a pin 21 to the handle 14 is urged counterclockwise by a spring 22. The clockwise pivoting of the actuator 20 is limited by an adjustable stop 23 which is movable by rotating a screw 24. The actuator 22 has a pair of gear segments or sections 25 in mesh with respective gears 27. A print head 29 has a pair of gear segments or racks 30 which mesh with respective gears 27. The print head 29 is mounted by the subframe 17 for straight-line reciprocating movement.

A feed wheel 38 has teeth 39. A ratchet wheel 41 has teeth 42. A pawl 43 is carried by the one gear 27 and cooperates successively with the teeth 42.

The housing 11 rotatably mounts an applicator roll 49. The subframe 17 mounts a platen 50 with which the print head 29 cooperates.

A label roll R is suitably mounted to portions 51 and 52 of the subframe.

U.S. Pat. No. 4,024,005 shows and describes the structure of the labeler 10 in additional detail and is thus incorporated herein by reference.

The label roll R is mounted on a pair of spaced mounting members 53 and 54. Although the roll R is shown to have a core R′, it is not necessary that a core be provided. The mounting members 53 and 54 are molded integrally with respective split shafts 55 and 56. The shafts 55 and 56 have respective heads or beads 57 and 58. The shafts 55 and 56 are shown to be rotatably mounted in respective bores 59 and 60 in respective subframe sections 18 and 19. The beads 57 and 58 enable insertion of the shaft 55 and 56 into respective bores 59 and 60, but prevent their withdrawal. The member 53, its shaft 55 and head 57 is of one-piece molded plastics construction and is a unitary part identical to the unitary part which comprises mounting member 54, its shaft 56 and head 58. A pair of spaced retainers 61 and 62 prevent both excessive telescoping and excessive mushrooming of the roll R. The retainers 61 and 62 are shown to be disposed directly opposite each other and are mirror-images of each other. The retainers 61 and 62 have respective arms 63, 64 and 65, 66. Each arm has a rib 67 which adds strength and also provides an effective face against which an edge of composite web C can be guided. The arms 63 and 64 of the retainer 61 are joined to a central portion 68 and arms 65 and 66 are joined to a central portion 69. The central portions 68 and 69 are slightly offset from their respective arms 63 and 64, and 65 and 66. The central portions 68 and 69 have respective holes 70 and 71 for receiving respective shafts 55 and 56. Stops 72 contact respective subframe sections 18 and 19 and prevent respective retainers 61 and 62 from rotating about respective shafts 55 and 56. Thus, arms 63 through 65 are always in the proper attitude. As shown in the drawings, the arms 63 and 65 extend upwardly and slightly to the rear of the labeler 10 and the arms 64 and 66 extend downwardly and to the rear of the labeler 10. The arms 63, 64 and 65, 66 have respective flanges 61' and 62'. The end faces 61'' and 62'' are opposed to each other and converge toward each other and open toward the rear of the labeler 10. When a label roll R is inserted onto the mounting members 53 and 54, the arms 63, 64 and 65, deflect until the roll R is mounted for rotation as shown in the drawings. The resiliency of the arms 63 through 66 enables them to return to their initial positions. As shown in FIGS. 2 and 5, the roll R is in alignment with flanges 61' and 62'. Thus, excessive unwinding or mushrooming of the roll R is prevented by flanges 61' and 62'. Some unwinding and some telescoping is tolerated by the retainers 61 and 62. The retainers 61 and 62 are easily constructed of a one-piece molded plastics material. The roll R comprises a web W which releasably carries labels L. The label carrying web W is guided to a printing position between the print head 29 and a platen 29' were the labels L are successively printed. From there the web W is caused to undergo a sharp change in direction at a delaminator 73 where a label is pelled off. From there the web W cooperates with feed wheel 38 and back-up roll 74. The web W exits the apparatus 10 to the rear as shown. The web 10 is advanced upon release of the actuator 20 following the printing of a label L.

Other embodiments and modifications of this invention will suggest themselves to those skilled in the art, and all such of these as come within the spirit of this invention are included within its scope as best defined by the appended claims.

I claim:

1. Hand-held apparatus for applying pressure sensitive labels releasably secured to a web of supporting material and including a housing having a handle, the housing having an access opening into which a label roll of said labels can be inserted, means for mounting the label roll in the housing in a position in which a substantial part of a full roll is outside the housing, a delaminator mounted by the housing, an applicator for applying delaminated labels, a driver for advancing the web, means defining a feed path from the label roll, to the delaminator where labels are successively peeled from the web, to the driver, and to a place of exit from the housing, and means for moving the driver to advance the web including a manually engageable actuator disposed at the handle, the improvement wherein the label roll mounting means includes a pair of spaced roll mounting members for rotatably mounting a label roll about an axis, a pair of spaced retainers adjacent the respective roll mounting members, each retainer having arms extending outwardly from the axis to obviate telescoping of the label roll, the arms being spaced to provide ease of insertion of the label onto the mounting members, and means for preventing rotation of the retainers.

2. Hand-held apparatus for applying pressure sensitive labels releasably secured to a web of supporting material and including a housing having a handle, the housing having an access opening into which a label roll of said labels can be inserted, means for mounting the label roll in the housing in a position in which a substantial part of a full roll is outside the housing, a delaminator mounted by the housing, an applicator for applying deliminated labels, a driver for advancing the web, means defining a feed path from the label roll, to the delaminator where labels are successively peeled from the web, to the driver, and to a place of exit from the housing, and means for moving the driver to advance the web including a manually engageable actuator disposed at the handle, the improvement wherein the label roll mounting means includes a pair of spaced roll mounting members for rotatably mounting a label roll about an axis, a pair of spaced retainers adjacent the respective roll mounting members, each retainer having arms extending outwardly from the axis to obviate telescoping of the label roll, the arms being spaced to provide ease of insertion of the label onto the mounting members, each retainer having a flange, the flanges extending toward each other and being disposed beyond the outer periphery of the roll in alignment with the label roll to prevent mushrooming of the label roll.

3. Hand-held apparatus for applying pressure sensitive labels releasably secured to a web of supporting material and including a housing having a handle, the housing having an access opening into which a label roll of said labels can be inserted, means for mounting the label roll in the housing in a position in which a substantial part of a full roll is outside the housing, a delaminator mounted by the housing, an applicator for applying delaminated labels, a driver for advancing the web, means defining a feed path from the label roll, to the delaminator where labels are successively peeled from the web, to the driver, and to a place of exit from the housing, and means for moving the driver to advance the web including a manually engageable actuator disposed at the handle, the improvement wherein the label roll mounting means includes a pair of spaced roll mounting members for rotatably mounting a label roll about an axis, a pair of spaced retainers adjacent the respective roll mounting members, each retainer having arms extending outwardly from the axis to obviate telescoping of the label roll, the arms being spaced to provide ease of insertion of the label onto the mounting members, each retainer having a flange, the flanges extending toward each other and being disposed beyond the outer periphery of the roll in alignment with the label roll to prevent mushrooming of the label roll, wherein the flanges have converging end edges opening generally toward the rear of the apparatus to facilitate loading of a label roll onto the mounting members.

4. Hand-held apparatus for applying pressure sensitive labels releasably secured to a web of supporting material and including a housing having a handle, the housing having an access opening into which a label roll of said labels can be inserted, means for mounting the label roll in the housing in a position in which a substantial part of a full roll is outside the housing, a delaminator mounted by the housing, an applicator for applying delaminated labels, a driver for advancing the web, means defining a feed path from the label roll, to the delaminator where labels are successively peeled from the web, to the driver, and to a place of exit from the housing, and means for moving the driver to advance the web including a manually engageable actuator disposed at the handle, the improvement wherein the label roll mounting means includes a pair of spaced roll mounting members for rotatably mounting a label roll about an axis, a pair of spaced retainers adjacent the respective roll mounting members, wherein each retainer is of molded plastics construction and has a central portion mounted on the respective mounting member and a pair of arms molded integrally with the central portion, wherein one arm extends upwardly and the other arm extends downwardly, and means for preventing rotation of the retainers.

5. Hand-held apparatus for applying pressure sensitive labels releasably secured to a web of supporting material and including a housing having a handle, the housing having an access opening into which a label roll of said labels can be inserted, means for mounting the label roll in the housing in a position in which a substantial part of a full roll is outside the housing, a delaminator mounted by the housing, an applicator for applying delaminated labels, a driver for advancing the web, means defining a feed path from the label roll, to the delaminator where labels are successively peeled from the web, to the driver, and to a place of exit from the housing, and means for moving the driver to advance the web including a manually engageable actuator disposed at the handle, the improvement wherein the label roll mounting means includes a pair of spaced roll mounting members for rotatably mounting a label roll about an axis, a pair of spaced retainers adjacent the respective roll mounting members, wherein each retainer is of molded plastics construction and has a pair of arms, one of the arms extending upwardly and slightly to the rear of the apparatus and the other arm extends downwardly and slightly to the rear of the apparatus, and means for preventing rotation of the retainers.

6. Apparatus as defined in either claim 1 or claim 5, wherein the rotation preventing means includes a stop member on each arm, each stop member being in contact with a stationary part of the apparatus.

7. Apparatus as defined in claim 6, wherein each arm includes a rib extending toward the label roll.

8. Apparatus as defined in claim 1, wherein the retainers are mirror-images of each other.

* * * * *